US006928833B2

(12) United States Patent
Watanabe et al.

(10) Patent No.: US 6,928,833 B2
(45) Date of Patent: Aug. 16, 2005

(54) FINNED TUBE FOR HEAT EXCHANGERS, HEAT EXCHANGER, PROCESS FOR PRODUCING HEAT EXCHANGER FINNED TUBE, AND PROCESS FOR FABRICATING HEAT EXCHANGER

(75) Inventors: Isao Watanabe, Oyama (JP); Shigeo Marugasa, Oyama (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 10/492,206

(22) PCT Filed: Oct. 22, 2002

(86) PCT No.: PCT/JP02/10911

§ 371 (c)(1),
(2), (4) Date: Apr. 22, 2004

(87) PCT Pub. No.: WO03/036213

PCT Pub. Date: May 1, 2003

(65) Prior Publication Data

US 2004/0261982 A1 Dec. 30, 2004

Related U.S. Application Data

(60) Provisional application No. 60/331,210, filed on Nov. 13, 2001.

(30) Foreign Application Priority Data

Oct. 22, 2001 (JP) ..... 2001-323677

(51) Int. Cl.[7] ..... F25B 39/02

(52) U.S. Cl. ..... 62/515; 165/151; 165/177; 29/890.044

(58) Field of Search ..... 62/259.1, 515; 165/146, 147, 150, 151, 177; 29/890.044

(56) References Cited

U.S. PATENT DOCUMENTS 4,306,619 A * 12/1981 Trojani ..... 165/179
4,381,592 A * 5/1983 Venables et al. ..... 29/890.048

(Continued)

FOREIGN PATENT DOCUMENTS

JP 57-195545 12/1982
JP 401102262 A * 4/1989

(Continued)

*Primary Examiner*—William E. Tapolcai
*Assistant Examiner*—Mohammad M. Ali
(74) *Attorney, Agent, or Firm*—Oblon, Spivak, McClelland, Maier & Neustadt, P.C.

(57) ABSTRACT

A heat exchanger finned tube 10 for use in fabricating a heat exchanger 1 useful as the evaporator for refrigerators or the like wherein a hydrocarbon refrigerant is used. Two tube insertion holes spaced apart from each other are formed in each of plate fins 12, and two straight tube portions 11*a* of a hairpin tube 11 are inserted through the respective holes of each plate fin to arrange the plate fins 12 in parallel into a plurality of fin groups 13 spaced apart on the straight tube portions 11*a* longitudinally thereof. The hairpin tube 11 is enlarged with use of a fluid to fixedly fit the plate fins 12 of each tin group 13 around an enlarged tube portion 14 of the hairpin tube 11 and provide a finless part 19 between each pair of adjacent fin groups 13 on each of the straight tube portions 11*a*. A restrained small-diameter portion 15 is provided in each of the finless parts 19 of each straight tube portion 11*a*. The heat exchanger 1 fabricated using the finned tube 10 exhibits the desired refrigeration performance with the leakage of refrigerant diminished.

36 Claims, 8 Drawing Sheets

U.S. PATENT DOCUMENTS 4,597,171 A * 7/1986 Kitayama et al. ..... 29/727
4,625,378 A * 12/1986 Tanno et al. ..... 29/890.046
4,839,950 A * 6/1989 Stroup ..... 29/890.047
5,207,270 A * 5/1993 Yokoyama et al. ..... 165/151
5,239,839 A * 8/1993 James ..... 62/434
5,267,610 A * 12/1993 Culbert ..... 165/151
6,202,703 B1 * 3/2001 Kuroda et al. ..... 138/178
6,325,138 B1 * 12/2001 Garosshen et al. ..... 165/133
6,349,761 B1 * 2/2002 Liu et al. ..... 165/151
6,460,372 B1 * 10/2002 Fung et al. ..... 62/515
6,578,628 B1 * 6/2003 Garosshen ..... 165/133

FOREIGN PATENT DOCUMENTS

JP 4-37428 2/1992
JP 405332642 A * 12/1993
JP 9-253775 9/1997
JP 410026437 A * 1/1998
JP 02000297995 A * 10/2000

* cited by examiner

FINNED TUBE FOR HEAT EXCHANGERS, HEAT EXCHANGER, PROCESS FOR PRODUCING HEAT EXCHANGER FINNED TUBE, AND PROCESS FOR FABRICATING HEAT EXCHANGER

CROSS REFERENCE TO RELATED APPLICATIONS

This application is an application filed under 35 U.S.C. §111(a) claiming the benefit pursuant to 35 U.S.C. §119(e)(1) of the filing date of Provisional Application No. 60/331,210 filed Nov. 13, 2001 pursuant to 35 U.S.C. §111(b).

TECHNICAL FIELD

The present invention relates to heat exchanger finned tubes for use in fabricating heat exchangers useful as evaporators of refrigeration devices such as refrigerators and refrigerated showcases, heat exchangers, a process for producing the finned tube and a process for fabricating the heat exchanger.

BACKGROUND ART

As evaporators of refrigeration devices such as refrigerators and refrigerated showcases, heat exchangers are in use which comprise a heat exchanger finned tube and formed in a zigzag shape in its entirety by bending the finned tube at a plurality of finless portions thereof. The finned tube comprises a hairpin tube, and a plurality of fin groups which are arranged on two straight tube portions of the hairpin tube longitudinally thereof at a spacing and each of which comprises a plurality of parallel plate fins extending across and fixed to the two straight tube portions.

Such heat exchangers have heretofore been fabricated by the following two processes.

The first of the processes is as follows. First prepared are two straight tubes, a multiplicity of plate fins each having two holes, and a tube enlarging device comprising a wire and a tube enlarging ball attached to one end of the wire. The two tubes are then inserted through the respective holes of each plate fin to thereby arrange the plate fins in parallel into a plurality of fin groups as spaced apart on the tubes longitudinally thereof. The wire of the tube enlarging device is subsequently inserted at the other end thereof through each tube and pulled at the other end to force the ball through the tube to enlarge the tube and fixedly fit the plate fins of each fin group around the tube. The two tubes are then welded, each at one end thereof, to opposite ends of a U-shaped bend to thereby interconnect the two tubes by the bend, whereby a heat exchanger finned tube is produced. The finned tube is thereafter bent into a zigzag form in its entirety at portions thereof having no fin groups. In this way, a heat exchanger is fabricated.

Studies are recently under way for the use of hydrocarbon refrigerants which are less likely to destroy the ozone layer and to influence global warming, in refrigerators, refrigerated showcases and like refrigeration devices as substitutes for chlorofluorocarbon refrigerants. Since the hydrocarbon refrigerants are flammable, there is a need to diminish the leakage of the refrigerant.

The heat exchanger fabricated by the first conventional process nevertheless has the following problems. Since the finned tube has seams between the U-shaped bend and the component tubes welded thereto, the refrigerant is likely to leak from the seam portions. Further in the case where the finned tube has, for example, inner fins arranged on its inner surface circumferentially thereof at a spacing and extending longitudinally of the tube so as to give an increased heat transfer area to the tube for an improved refrigeration efficiency, the enlarging ball is more likely to collapse the inner fins to result in increased resistance to the flow of refrigerant and impaired refrigeration performance if the inner fins have an excessive height. Accordingly, the inner fins can not be given an increased height and are less effective for an increase in the heat transfer area, hence a limitation to the improvement in refrigeration efficiency.

Heat exchangers for use as evaporators in refrigerators and refrigerated showcases are fabricated by the second process to be described below. First prepared are a hairpin tube, a multiplicity of plate fins each having two holes which are spaced apart, and a tube enlarging device comprising a pressure rod and an enlarging mandrel attached to one end of the rod. The two straight tube portions of the hairpin tube are then inserted through the respective holes of each plate fin to thereby arrange the plate fins in parallel into a plurality of fin groups as spaced apart on the tube portions longitudinally thereof. The mandrel of the tube enlarging device is subsequently forced into the straight tube portions from each open end of the hairpin tube to enlarge the tube portions and to fixedly fit the plate fins of each fin group around the tube portions of the hairpin tube, whereby a heat exchanger finned tube is produced. The finned tube is thereafter bent into a zigzag form in its entirety at portions thereof having no fin groups. In this way, a heat exchanger is fabricated.

The heat exchanger produced by the second process has no seams in the hairpin tube of the finned tube, so that no leakage of the refrigerant occurs unlike the heat exchanger obtained by the first process. However, the heat exchanger produced by the second process also has the following problem. In the case where the finned tube has, for example, inner fins arranged on its inner surface circumferentially thereof at a spacing and extending longitudinally of the tube so as to give an increased heat transfer area to the tube for an improved refrigeration efficiency, the enlarging mandrel is more likely to collapse the inner fins to result in increased resistance to the flow of refrigerant and impaired refrigeration performance if the inner fins have an excessive height. Accordingly, the inner fins can not be given an increased height and are less effective for an increase in the heat transfer area, hence a limitation to the improvement in refrigeration efficiency.

In order to prevent the inner fins from collapsing, therefore, it is thought useful to enlarge the hairpin tube in its entirety by introducing a pressure fluid into the tube in the second process. In this case, however, the circumferential wall of the tube wrinkles in portions thereof having no fin groups, deforming the tube longitudinally thereof to vary the length of the finned tube and failing to afford a heat exchanger of desired dimensions. The heat exchanger finned tube is bent at a plurality of finless portions thereof, whereas the tube is likely to collapse when bent if wrinkles or creases develop in such portions. Further before the hairpin tube is enlarged, the straight tube portions of the tube are not restrained in any way of course at the finless parts thereof or at the portions thereof provided with the fin group, so that the application of the pressure fluid for the enlargement of the tube involves the problem of greatly deflecting the straight tube portions over the entire length thereof. Additionally, the hairpin tube is likely to rupture at finless portions when enlarged.

An object of the present invention is to overcome the foregoing problems and to provide a heat exchanger which is capable of exhibiting the desired refrigeration performance with the leakage of refrigerant diminished.

DISCLOSURE OF THE INVENTION

The present invention provides a finned tube for use in heat exchangers which comprises a hairpin tube having two straight tube portions, and a plurality of fin groups arranged on the straight tube portions longitudinally thereof at a spacing, each of the fin groups comprising a plurality of parallel plate fins extending across and fixed to the two straight tube portions, each of the plate fins having two tube insertion holes spaced apart from each other, the plate fins being fixedly fitted around an enlarged tube portion of the hairpin tube by inserting the two straight tube portions through the respective holes of each plate fin and enlarging the hairpin tube with use of a fluid, the straight tube portions each having a finless part between each pair of adjacent fin groups thereon, at least one of all the finless parts of each straight tube portion having a restrained small-diameter portion smaller than the enlarged tube portion in diameter and having a predetermined length.

The heat exchanger finned tube of the invention comprises a hairpin tube and therefore has no seam, so that the heat exchanger fabricated with use of the finned tube can be diminished in the leakage of refrigerant, consequently permitting the use of a hydrocarbon refrigerant which is less likely to destroy the ozone layer and exert influence on global warming. Since the plate fins are fixedly fitted around the straight tube portions of the hairpin tube by enlarging the tube with the use of a fluid, inner fins of relatively great height of projection are unlikely to collapse, even if formed on the inner peripheral surface of the hairpin tube to afford an increased area of heat transfer, enabling the heat exchanger to exhibit the desired refrigeration performance (heat exchange performance). At least one of all the finless parts of each straight tube portion of the hairpin tube has a restrained small-diameter portion of a smaller diameter than the enlarged tube portions and a predetermined length, and the small-diameter portion is restrained when the tube is enlarged with the use of the fluid. Accordingly, the unrestrained portions of the straight tube portion have a relatively short length in the state of the tube to be enlarged. This prevents the straight tube portion of the hairpin tube from being deflected greatly by the enlargement of the tube.

With the heat exchange finned tube of the invention, the restrained small-diameter portion may be provided in each of the finless parts of each straight tube portion of the hairpin tube.

Since the small-diameter portion is restrained when the tube is enlarged with the fluid in this case, this portion to be restrained and included in the straight tube portion becomes greater in length than in the state thereof before enlargement. This reliably precludes the straight tube portion of the hairpin tube from being deflected greatly by the enlargement of the tube.

With the heat exchanger finned tube of the invention, each of opposite ends of the restrained small-diameter portion may be made integral with the enlarged tube portion by a flaring portion formed therebetween and increasing in diameter toward the enlarged tube portion.

Because each end of the restrained small-diameter portion is made integral with the enlarged tube portion by the flaring portion formed therebetween and increasing in diameter toward the enlarged tube portion, all the plate fins of each fin group can be reliably fixedly fitted around the enlarged tube portion when the hairpin tube is enlarged.

With the heat exchanger finned tube of the invention, the restrained small-diameter portion may be an unenlarged tube portion.

In bending the finned tube for fabricating a heat exchanger, the unenlarged tube portion is to be bent in this case. The unenlarged tube portion is not worked on in the preceding step, is therefore free from work hardening and is consequently amenable to bending work.

With the heat exchanger finned tube of the invention, the hairpin tube may be integrally provided on an inner peripheral surface thereof with inner fins extending longitudinally thereof and arranged at a spacing circumferentially thereof.

The heat exchanger to be fabricated with the use of this finned tube then exhibits improved heat exchange performance.

With the heat exchanger finned tube of the invention which tube is finned also internally, the hairpin tube may have high and low two kinds of inner fins alternately arranged circumferentially thereof and projecting from the inner peripheral surface of the tube to different heights, the high inner fins being 0.7 to 1.7 mm in height from the surface of the hairpin tube, the low inner fins being 0.4 to 1.2 mm in height from the surface.

The heat exchanger to be fabricated with the use of this finned tube is then effectively improved in heat exchange performance.

With the heat exchanger finned tube of the invention which tube is finned also internally, all the inner fins may be equal in height and are 0.7 to 1.2 mm in height from the inner peripheral surface of the hairpin tube.

The heat exchanger to be fabricated with the use of this finned tube is then effectively improved in heat exchange performance.

With the heat exchanger finned tube of the invention which tube is finned also internally, the pitch of the inner fins is 0.4 to 1.6 mm.

With the heat exchanger finned tube of the invention which tube is finned also internally, the hairpin tube is 6 to 10 mm in outside diameter and 0.4 to 0.8 mm in the wall thickness of a circumferential wall thereof.

The present invention provides a heat exchanger comprising a heat exchanger finned tube according to claim 1 and formed in a zigzag shape in its entirety by bending the straight tube portions of the hairpin tube in the same direction at each pair of finless parts located in the same position with respect to the longitudinal direction of the straight tube portions, each pair of finless parts adjacent to each other longitudinally of the straight tube portions being bent in different directions.

The heat exchanger of the invention has the same advantages as previously described with reference to the finned tube.

With the heat exchanger of the invention, each finless part of each of the straight tube portions of the hairpin tube may have a restrained small-diameter portion, and the heat exchanger finned tube is bent at the restrained small-diameter portion of each finless part.

In this case, the small-diameter portion is restrained when the tube is enlarged with the fluid, is enlarged in no way or only slightly, is worked on in no way or slightly, and is diminished in the degree of work hardening. This portion can therefore be bent easily.

With the heat exchanger of the invention, the hairpin tube may be integrally provided on an inner peripheral surface thereof with inner fins extending longitudinally thereof and arranged at a spacing circumferentially thereof. The heat exchanger then exhibits outstanding heat exchange performance.

With the heat exchanger wherein the hairpin tube of the finned tube is finned also internally, the hairpin tube may have high and low two kinds of inner fins alternately arranged circumferentially thereof and projecting from the inner peripheral surface of the tube to different heights, the high inner fins being 0.7 to 1.7 mm in height from the surface of the hairpin tube, the low inner fins being 0.4 to 1.2 mm in height from the surface. The heat exchanger then exhibits further improved heat exchange performance.

With the heat exchanger wherein the hairpin tube of the finned tube is finned also internally, all the inner fins are equal in height and are 0.7 to 1.2 mm in height from the inner peripheral surface of the hairpin tube. The heat exchanger then exhibits still improved heat exchange performance.

With the two heat exchangers described wherein the hairpin tube of the finned tube is finned also internally, the pitch of the inner fins may be 0.4 to 1.6 mm.

With the two heat exchangers described wherein the hairpin tube of the finned tube is finned also internally, the hairpin tube may be 6 to 10 mm in outside diameter and 0.4 to 0.8 mm in the wall thickness of a circumferential wall thereof.

The present invention provides a refrigerator which is provided with a refrigeration cycle having a compressor, a condenser and an evaporator, the evaporator being a heat exchanger according to any one of claims 10 to 18, and wherein a hydrocarbon refrigerant is used as the refrigerant and circulated at a rate of 1 to 9 kg/h.

The present invention provides a refrigerated showcase which is provided with a refrigeration cycle having a compressor, a condenser and an evaporator, the evaporator being a heat exchanger according to any one of claims 10 to 18, and wherein a hydrocarbon refrigerant is used as the refrigerant and circulated at a rate of 1 to 9 kg/h.

The present invention provides a process for producing a finned tube for use in heat exchangers which process comprises preparing a hairpin tube having two straight tube portions, and a multiplicity of plate fins each having two tube insertion holes spaced apart from each other, inserting the two straight tube portions through the respective holes of each plate fin to arrange the plate fins in parallel into a plurality of fin groups spaced apart on the straight tube portions longitudinally thereof and provide a finless part between each pair of adjacent fin groups on each of the straight tube portions, restraining at least one of all the finless parts of each straight tube portion by a restraining die having a cylindrical restraining portion with a diameter smaller than the inside diameter of the tube insertion holes of the plate fins, and introducing a fluid into the hairpin tube in this state to enlarge the tube and fixedly fit the plate fins of each fin group around an enlarged tube portion of the hairpin tube.

The process of the invention is adapted to produce the heat exchanger finned tube having the foregoing advantages relatively easily. The hairpin tube is enlarged with a fluid introduced thereinto, with at least one of the finless parts of each straight tube portion restrained by a die having a cylindrical restraining portion with a diameter smaller than the inside diameter of the tube insertion holes of the plate fins, with the result that the straight tube portion of the hairpin tube is precluded from being deflected greatly by the tube enlarging operation.

In the process of the invention for producing a heat exchanger finned tube, each of the finless parts of each straight tube portion of the hairpin tube may be restrained by the restraining die. This reliably precludes the straight tube portion of the hairpin tube from being deflected greatly by the enlargement of the tube. Moreover, the hairpin tube is prevented from being ruptured by the enlargement at the portions thereof having no fin group.

With the process of the invention for producing a heat exchanger finned tube, the restraining die may have a cavity comprising a cylindrical restraining portion having a predetermined length, two flaring portions extending from respective opposite ends of the restraining portion and increasing in diameter outward longitudinally of the restraining portion, and tube enlargement permitting portions extending from respective larger ends of the flaring portions and having an inside diameter not smaller than the inside diameter of the holes of the plate fins.

With the process of the invention for producing a heat exchanger finned tube, the restraining portion may have an inside diameter equal to the outside diameter of the hairpin tube before enlargement. The restrained small-diameter portion present in the finless part of the finned tube obtained in this case is an unenlarged tube portion. In bending the finned tube for fabricating a heat exchanger, the unenlarged tube portion is to be bent. The unenlarged tube portion is not worked on in the preceding step, is therefore free from work hardening and can consequently be bent easily.

In the process of the invention for producing a heat exchange finned tube, the hairpin tube may be integrally provided on an inner peripheral surface thereof with inner fins extending longitudinally thereof and arranged at a spacing circumferentially thereof.

The plate fins of each fin group are fixedly fitted around the straight tube portion of the hairpin tube by enlarging the hairpin tube with the fluid introduced thereinto, so that the inner fins are prevented from collapsing by the enlargement of the tube. The heat exchanger fabricated with the use of the finned tube therefore exhibits outstanding heat exchange performance.

In the process for producing a heat exchange finned tube which is finned also internally, the hairpin tube may have high and low two kinds of inner fins alternately arranged circumferentially thereof and projecting from the inner peripheral surface of the tube to different heights, the high inner fins being 0.7 to 1.7 mm in height from the surface of the hairpin tube, the low inner fins being 0.4 to 1.2 mm in height from the surface.

In the process for producing a heat exchange finned tube which is finned also internally, all the inner fins may be equal in height and are 0.7 to 1.2 mm in height from the inner peripheral surface of the hairpin tube.

In the process for producing the two heat exchange finned tubes which are finned also internally, the pitch of the inner fins is 0.4 to 1.6 mm.

In the process for producing the two heat exchange finned tubes which are finned also internally, the hairpin tube is 6 to 10 mm in outside diameter and 0.4 to 0.8 mm in the wall thickness of a circumferential wall thereof.

The present invention provides a process for fabricating a heat exchanger comprising a heat exchanger finned tube produced by a process according to claim 21, the heat exchanger being formed in a zigzag shape in its entirety by bending the straight tube portions of the hairpin tube in the same direction at each pair of finless parts located in the same position with respect to the longitudinal direction of the straight tube portions, each pair of finless parts adjacent to each other longitudinally of the straight tube portions being bent in different directions.

This process for fabricating the heat exchanger also has the same advantages as already described with reference to the finned tube.

In the process of the invention for fabricating a heat exchanger by using a heat exchanger finned tube produced by the process according to claim 22, the finned tube may be bent at the portion of the finless part restrained by the restraining portion of the restraining die.

In this case, the restrained portion is bent when the finned tube is to be bent zigzag. The restrained portion is enlarged in no way or only slightly, is therefore worked on in no way or slightly, and is diminished in the degree of work hardening. This portion can therefore be bent easily.

In the process of the invention for fabricating a heat exchanger, the hairpin tube of the heat exchanger finned tube may be integrally provided on an inner peripheral surface thereof with inner fins extending longitudinally thereof and arranged at a spacing circumferentially thereof.

In the process for fabricating a heat exchanger wherein the hairpin tube is finned internally, the hairpin tube may have high and low two kinds of inner fins alternately arranged circumferentially thereof and projecting from the inner peripheral surface of the tube to different heights, the high inner fins being 0.7 to 1.7 mm in height from the surface of the hairpin tube, the low inner fins being 0.4 to 1.2 mm in height from the surface.

In the process for fabricating a heat exchanger wherein the hairpin tube is finned internally, all the inner fins are equal in height and are 0.7 to 1.2 mm in height from the inner peripheral surface of the hairpin tube.

In the process for fabricating the two heat exchangers wherein the hairpin tube is finned internally, the pitch of the inner fins is 0.4 to 1.6 mm.

In the process for fabricating the two heat exchangers wherein the hairpin tube is finned internally, the hairpin tube is 6 to 10 mm in outside diameter and 0.4 to 0.8 mm in the wall thickness of a circumferential wall thereof.

BEST MODE OF CARRYING OUT THE INVENTION

Embodiments of the present invention will be described below with reference to the drawings. The term "aluminum" as used in the following description includes aluminum alloys in addition to pure aluminum. Further in the following description, the left- and right-hand sides of FIGS. 1 to 4 will be referred to as "left" and "right", respectively.

Figure 1:
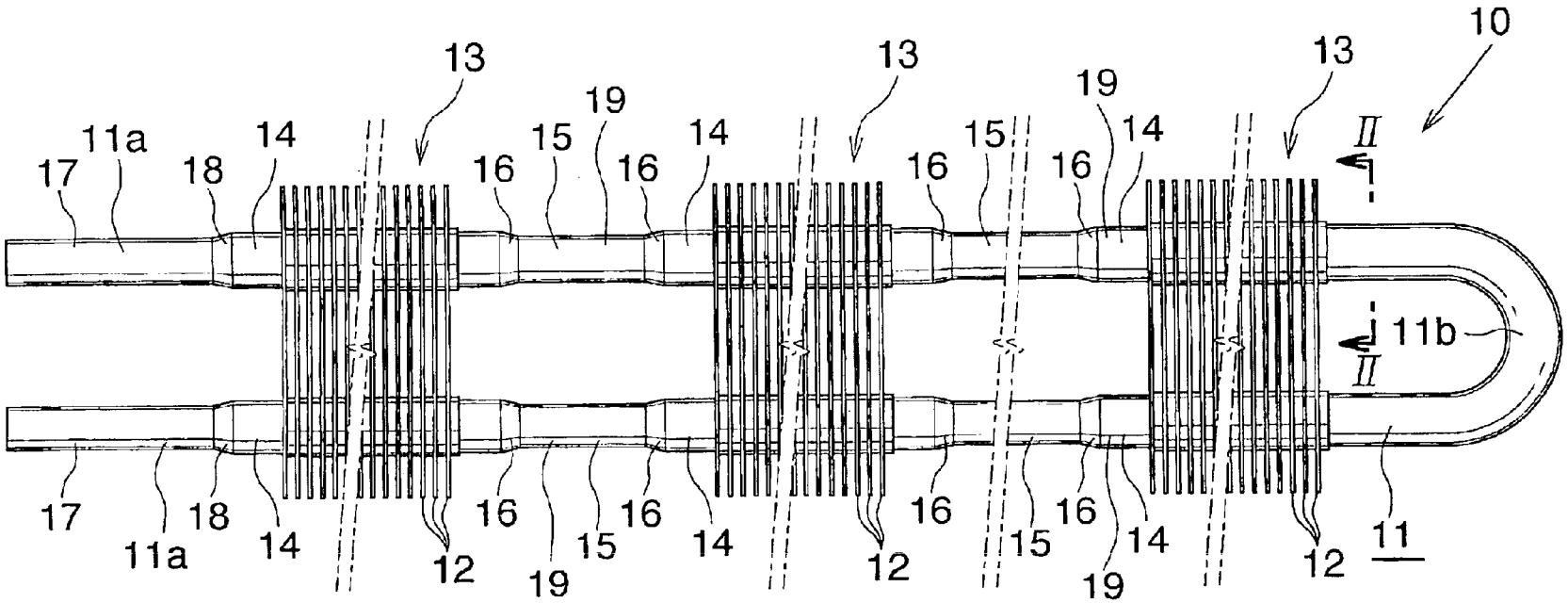
FIG. 1 is a plan view partly omitted and showing a finned tube of the invention for use in heat exchangers.
Figure 2:
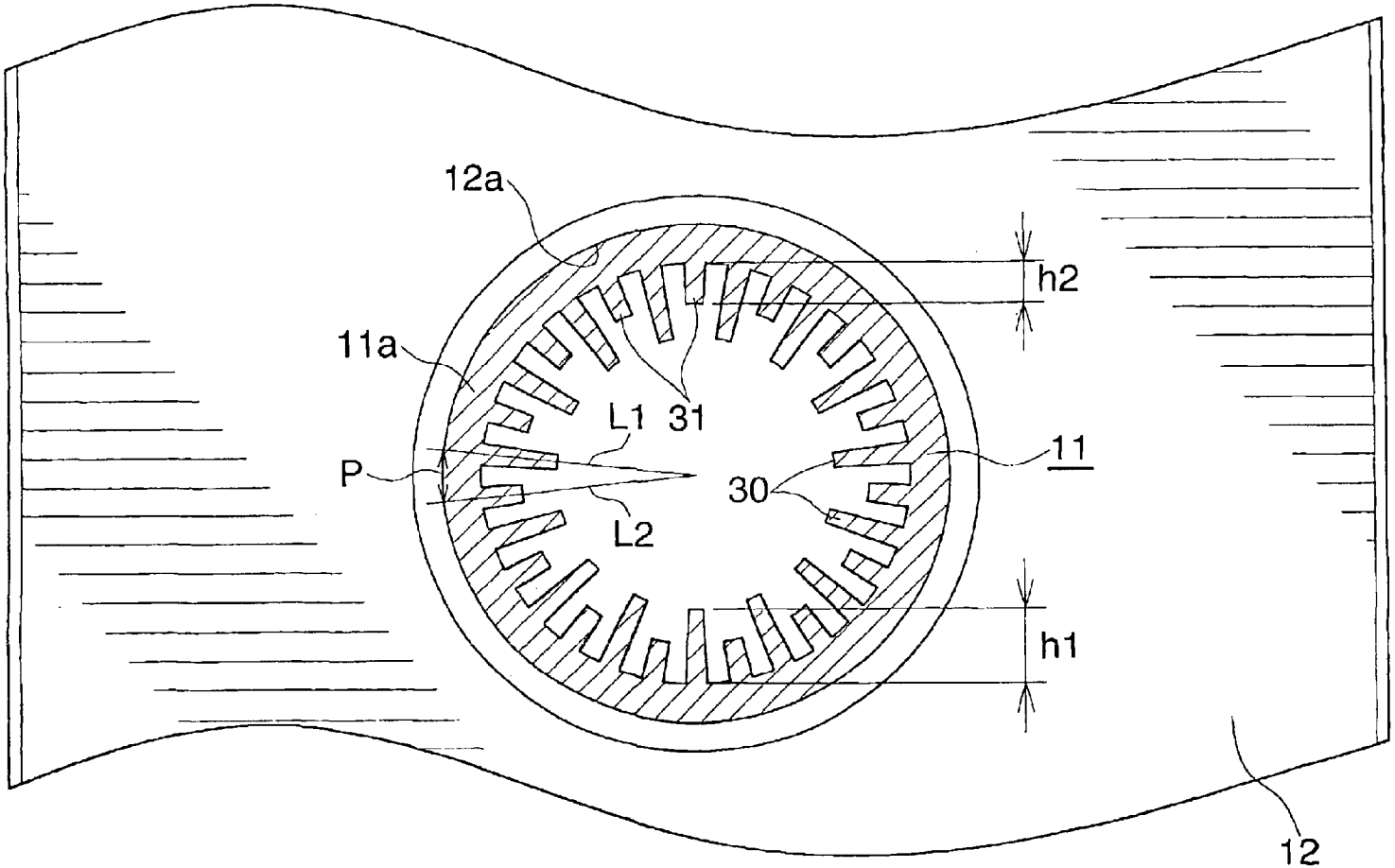
FIG. 2 is an enlarged view in section taken along the line II—II in FIG. 1.
Figure 3:
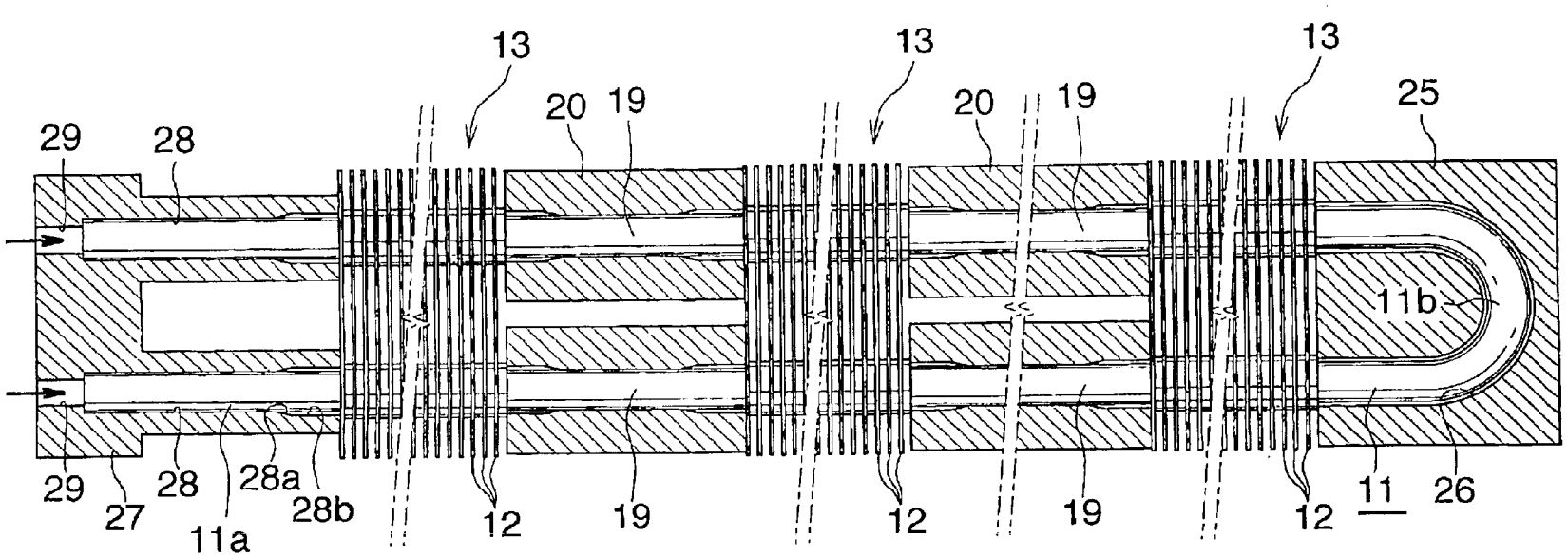
FIG. 3 is a sectional view showing a process for producing the finned tube of FIG. 1, a hairpin tube being shown before enlargement.
Figure 4:
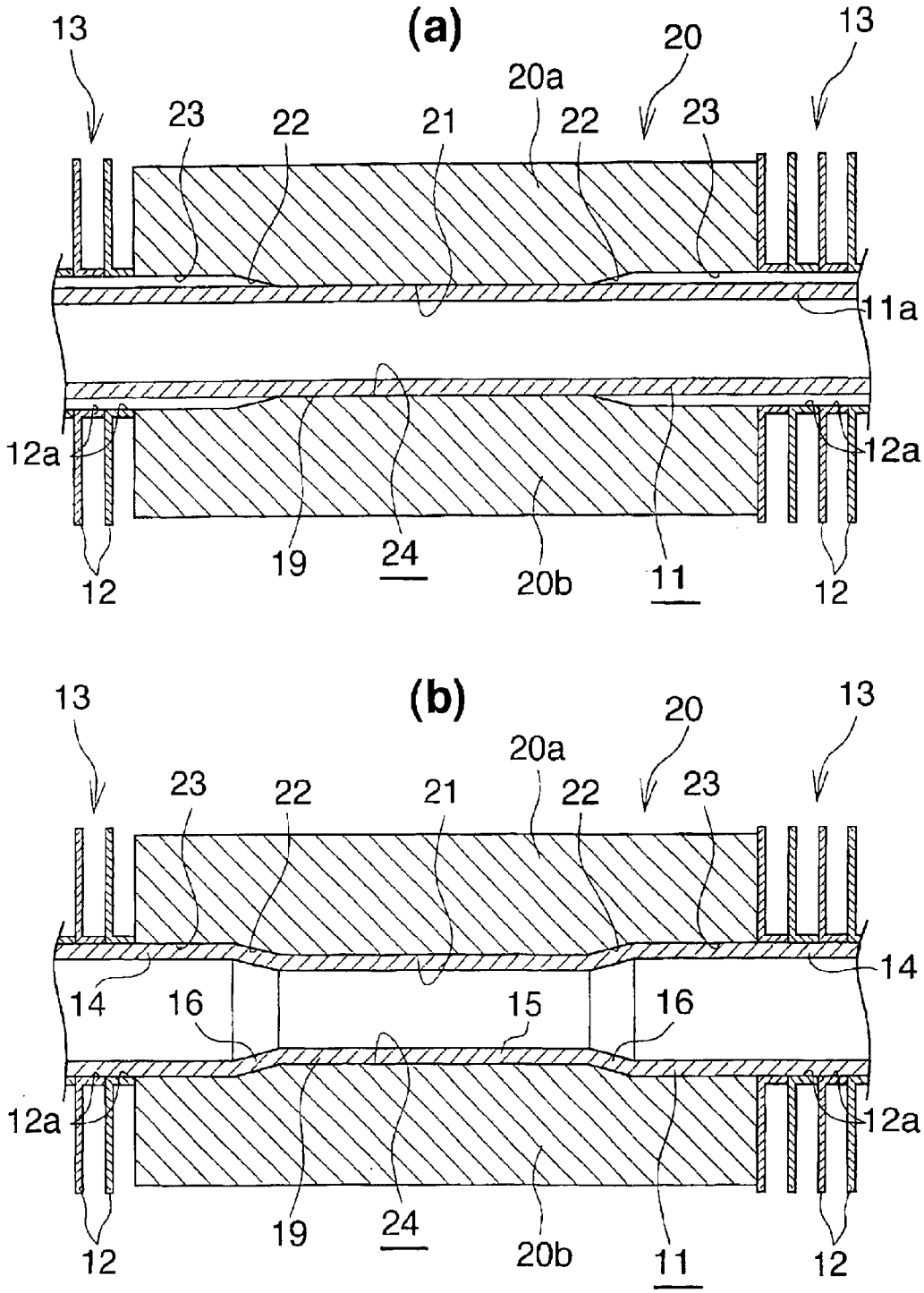
FIG. 4 shows a process for producing the heat exchanger finned tube of FIG. 1, (a) being an enlarged fragmentary view in section of the hairpin tube before enlargement; (b) being an enlarged fragmentary view in section of the hairpin tube after enlargement.
Figure 5:
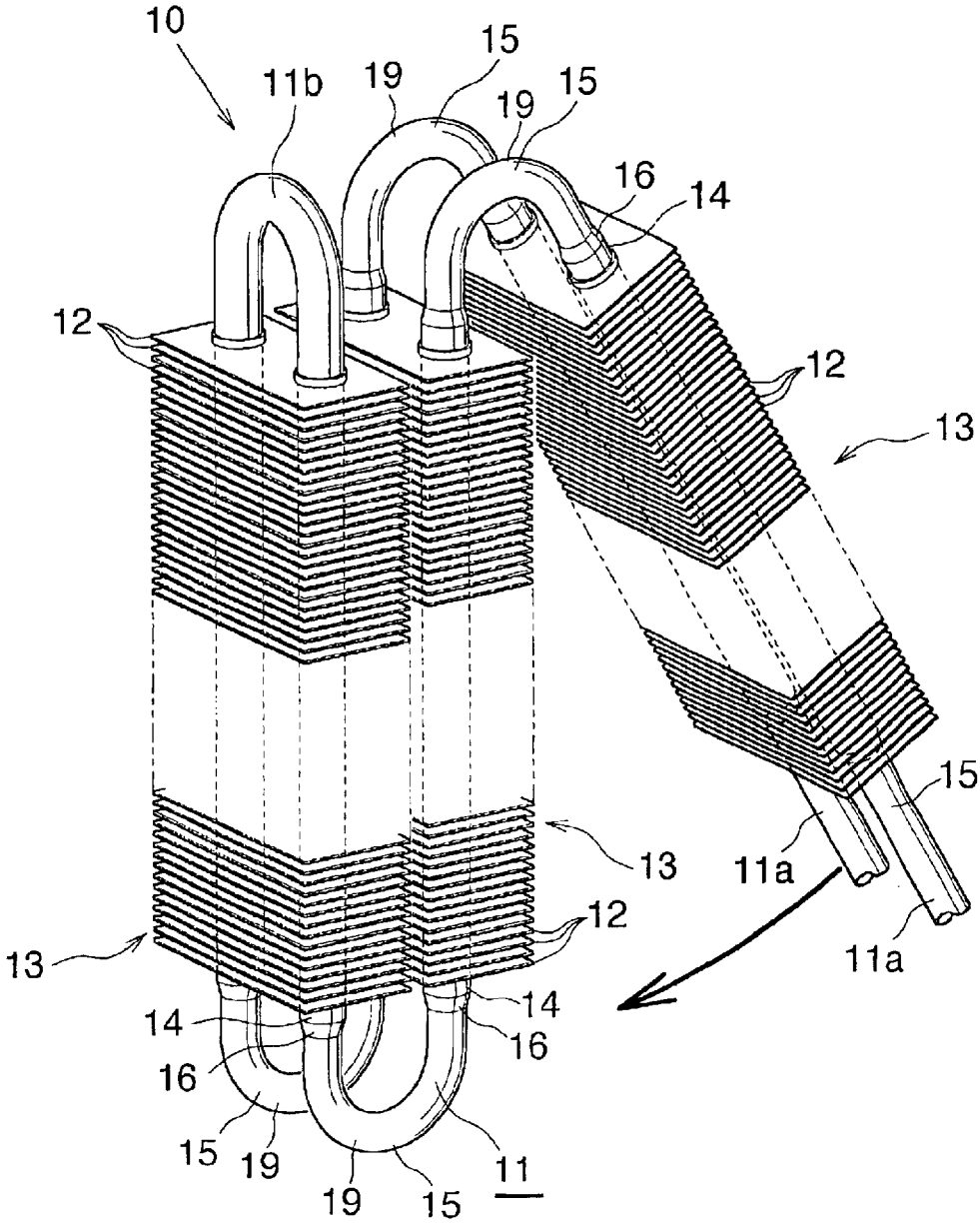
FIG. 5 is a fragmentary perspective view showing a process for fabricating a heat exchanger using the finned tube.
Figure 6:
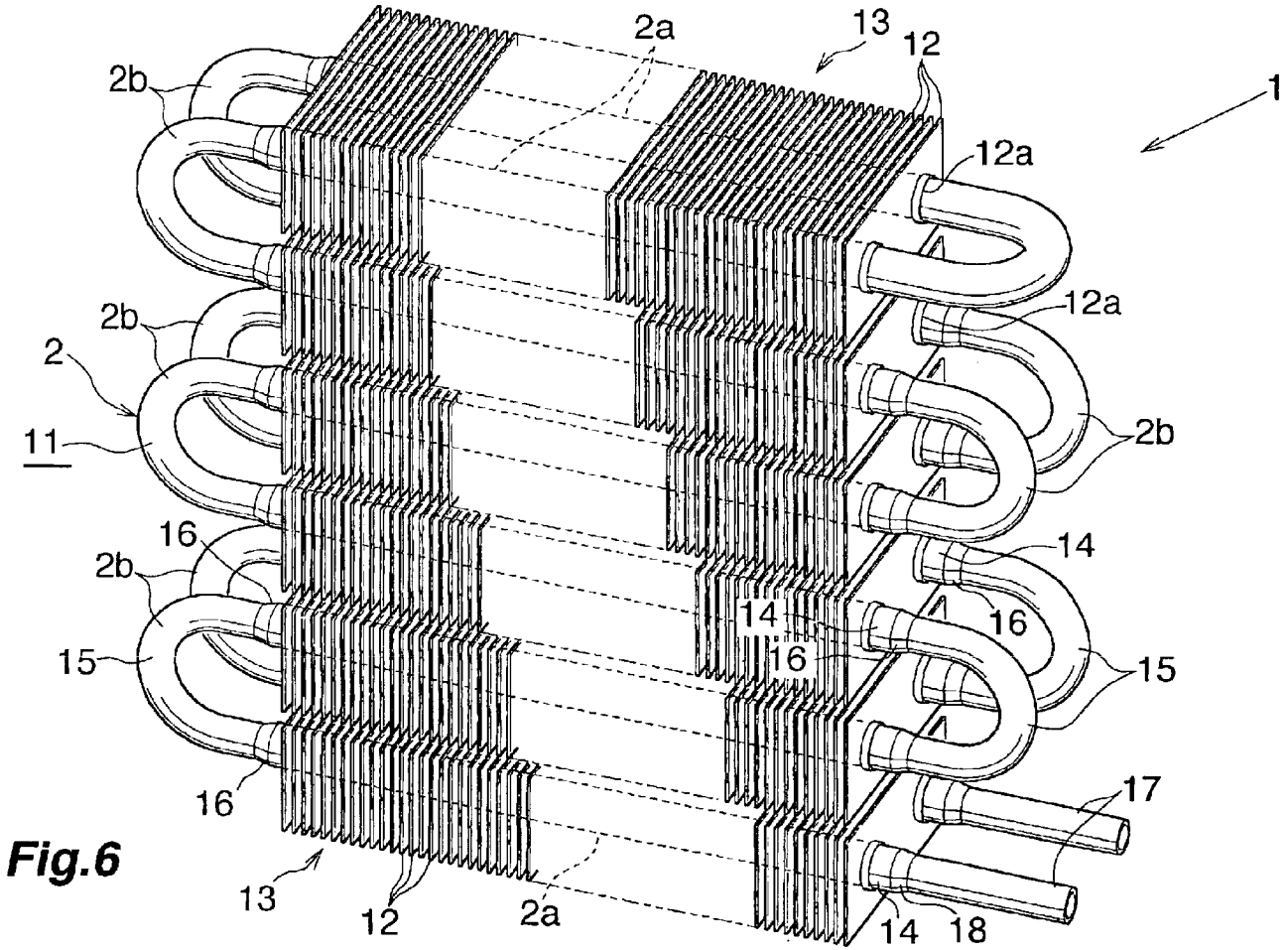
FIG. 6 is a perspective view showing the overall construction of the heat exchanger of the invention.

FIGS. 1 and 2 show a finned tube for use in heat exchanger, FIGS. 3 and 4 show a process for producing the finned tube, and FIG. 5 shows a process for fabricating a heat exchanger with the use of the finned tube. Further FIG. 6 shows the overall construction of the heat exchanger fabricated using the finned tube.

With reference to FIGS. 1 and 2, a finned tube 10 for use in heat exchangers comprises a hairpin tube 11 of aluminum, and a plurality of fin groups 13 arranged on two straight tube portions 11*a* of the hairpin tube 11 longitudinally thereof at a spacing. The straight tube portions 11*a* each have a finless part 19 between each pair of adjacent fin groups 13 thereon. The fin group 13 comprises a plurality of parallel aluminum plate fins 12 extending across and fixed to the two straight tube portions 11*a* of the hairpin tube 11.

The hairpin tube 11 is integrally provided with high and low two kinds of inner fins 30, 31 projecting from the inner peripheral surface of the tube to different heights, extending longitudinally thereof, and alternately arranged circumferentially thereof at a spacing. The inner fins 30, 31 project toward the center of the hairpin tube 11. The high inner fins 30 are 0.7 to 1.7 mm in height h1 as measured from the inner peripheral surface of the hairpin tube 11, and the low inner fins 31 are 0.4 to 1.2 mm in height h2 as measured from the surface of the hairpin tube 11. The pitch p of the inner fins 30, 31 is 0.4 to 1.6 mm. The pitch p of the inner fins 30, 31 is the circumferential distance, as measured in cross section on the outer periphery of the hairpin tube 11, between two straight lines connecting the center line of the hairpin tube 11 and the centers of the thicknesses of a pair of adjacent inner fins 30, 31. The hairpin tube 11 is 6 to 10 mm in outside diameter, and 0.4 to 0.8 mm in the thickness of the circumferential wall thereof.

Each of the plate fins 12 has two tube insertion holes 12*a*. The plate fins 12 are fixedly fitted around the straight tube portions 11*a* of the hairpin tube 11 by inserting the two straight tube portions 11*a* through the respective two holes 12*a* of each plate fin 12 and enlarging the hairpin tube at the portions thereof where the fins groups 13 are to be provided, with use of a fluid such as water, oil or air. The enlarged tube portions are indicated at 14. The hairpin tube 11 has a bent portion 11*b* which is enlarged in its entirety and given the same diameter as the enlarged portions 14 for fixing to the straight tube portions 11*a* the group 13 of the plate fins 12 adjacent to the bent portion 11*b*. Each enlarged tube portion 14 has a larger length than the width of the fin group 13 in the leftward or rightward direction, and has left and right ends positioned leftwardly and rightwardly externally of the respective plate fins 12 at the left and right ends of the fin group 13.

Each of the finless parts 19 has a restrained small-diameter portion 15 of a predetermined length. Each of left and right ends of the restrained small-diameter portion 15 is made integral with the enlarged tube portion 14 by a flaring portion 16 formed therebetween and increasing in diameter toward the enlarged tube portion 14. The restrained small-diameter portions 15 of the two straight tube portions 11*a* are in the same position with respect to the longitudinal direction of the tube portions 11*a*. The hairpin tube 11 has portions also providing restrained small-diameter portions 17 and closer to the openings thereof than the enlarged tube portions 14 for fixing the plate fins 12 of the fin group 13 at the open ends (left ends) of the hairpin tube 11. These small-diameter portions 17 each have a right end made integral with the enlarged tube portion 14 by a flaring portion 18 formed therebetween and increasing in diameter toward the enlarged tube portion 14. The restrained small-diameter portions 15, 17 are each in the form of an unenlarged tube portion which is not enlarged when the straight tube portions are enlarged as described above. Instead of being unenlarged tube portions, the restrained small-diameter portions 15, 17 may be slightly enlarged tube portions which have a diameter smaller than the inside diameter of the tube insertion holes 12*a* of the plate fin 12, i.e., the outside diameter of the enlarged tube portions 14, but which are slightly enlarged.

The finned tube 10 for use in heat exchangers is produced in the manner shown in FIGS. 3 and 4.

A hairpin tube 11 of aluminum having two straight tube portions, and a multiplicity of aluminum plate fins 12 are prepared. Each of the plate fins 12 has two tube insertion holes 12*a* spaced apart from each other. The two straight tube portions 11*a* of the hairpin tube 11 are inserted through the respective holes 12*a* of each plate fin 12 to arrange the plate fins 12 in parallel-into a plurality of fin groups 13 spaced apart on the straight tube portions 11*a* longitudinally thereof. A restraining die 20 is then used for restraining the finless part 19 between each pair of adjacent fin groups 13 on the straight tube portions 11*a* of the hairpin tube 11. The restraining die 20 comprises two die members 20*a*, 20*a*, and has a cavity 24 comprising a cylindrical restraining portion 21 having a predetermined length and an inside diameter equal to the outside diameter of the hairpin tube 11 before enlargement, two flaring portions 22 extending from respective opposite ends of the restraining portion 21 and increasing in diameter outward longitudinally of the restraining portion, and short cylindrical tube enlargement permitting portions 23 extending from respective larger ends of the flaring portions 22 and having an inside diameter not smaller than the inside diameter of the holes 12*a* of the plate fins 12 [see FIG. 4(*a*)].

Further the bent portion 11*b* of the hairpin tube 11 is restrained by a second restraining die 25. This die 25 has a U-shaped cavity 26 circular in cross section. The cavity 26 has an inside diameter larger than the outside diameter of the hairpin tube 11 before enlargement and equal to the inside diameter of the tube enlargement permitting portion 23 of the first restraining die 20. The opposite end portions of the hairpin tube 11 are restrained by a fluid introduction jig 27. The jig 27 has two cylindrical restraining portions 28 having an inside diameter equal to the outside diameter of the hairpin tube 11 before enlargement, and two fluid inlet passageways 29 communicating with the respective restraining portions 28 (see FIG. 3). The jig 27 has a flaring portion 28b extending from the right end of each restraining portion 28 and increasing in diameter rightward, and an enlargement permitting portions 28*b* extending from the larger end of the flaring portion 28*a* and having the same inside diameter as the enlargement permitting portion 23 of the first die 20.

Subsequently, a pressure fluid, such as water, oil or air, is introduced from the inlet passageways 29 of the jig 27 into the hairpin tube 11 in this state to enlarge the hairpin tube 11 at the portions thereof except the portions restrained by the restraining portions 21 of the die 20 and the restraining portions 28 of the jig 27 and to fixedly fit the plate fins 12 of the fin groups 13 around the enlarged tube portions 14 formed in the straight tube portions 11*a* of the hairpin tube 11. The restrained small-diameter portions 15, 17 and flaring portions 16, 18 are formed by this enlarging operation [see FIG. 4(*b*)]. In this way, the heat exchanger finned tube 10 is produced.

The use of the restraining dies 20 described above in the process prevents the straight portions 11*a* of the hairpin tube 11 from being deflected greatly with the pressure fluid introduced into the hairpin tube 11, further precluding the restrained small-diameter portions 15 from wrinkling in the circumferential wall and the straight tube portions 11*a* from deforming longitudinally thereof due to wrinkling when the pressure fluid is introduced into the hairpin tube 11. Since the tube is enlarged with the pressure fluid, the inner fins 30, 31 are prevented from collapsing. The finless parts 19 of the hairpin tube 11 are also prevented from rupturing.

As shown in FIG. 5, the finned tube 10 is bent at the restrained small-diameter portions 15 between the adjacent fin groups 13, whereby the tube is formed zigzag in its entirety. FIG. 6 shows a heat exchanger 1 thus fabricated for use as an evaporator in refrigerators or refrigerated showcases. Stated more specifically, the straight tube portions 11*a* of the hairpin tube 11 are bent in the same direction at the restrained small-diameter portions 15 of each pair of finless parts 19 which are located in the same position with respect to the longitudinal direction of the straight tube portions 11*a* so that a straight line through the lengthwise centers of the portions 15 will be the center of the curvature, and each pair of finless parts 19 adjacent to each other longitudinally of the straight tube portions 11*a* are bent in different directions, whereby the hairpin tube 11 is bent zigzag in its entirety.

Thus, the finned tube 10 is bent at the restrained small-diameter portions 15 and can therefore be bent easily. Because the restrained small-diameter portions 15 are not worked on in the preceding steps, these portions 15 are free of work hardening and can consequently be bent easily.

With reference to FIG. 6, the heat exchanger 1 comprises a zigzag heat exchange tube 2 comprising a hairpin tube 11 bent zigzag, and fin groups 13 provided around each straight tube portion 2*a* of the zigzag heat exchange tube 2 and each comprising a plurality of parallel plate fins 12. A plurality of bent portions 2*b* at the left and right sides of the zigzag heat exchange tube 2 each comprise a restrained small-diameter portion 15. Although not shown, the bent portions 2*b* of the tube 2 at the left and right are held by respective side plates.

The heat exchanger 1 is used as the evaporator of a refrigerator which is provided with a refrigeration cycle having a compressor, condenser and evaporator, and wherein a hydrocarbon refrigerant is used as the refrigerant. In this refrigerator, the refrigerant is circulated at a low rate of 1 to 9 kg/h.

The heat exchanger 1 is used also as the evaporator of a refrigerated showcase which is provided with a refrigeration cycle having a compressor, condenser and evaporator, and wherein a hydrocarbon refrigerant is used as the refrigerant. In this refrigerated showcase, the refrigerant is circulated at a low rate of 1 to 9 kg/h.

Figure 7:
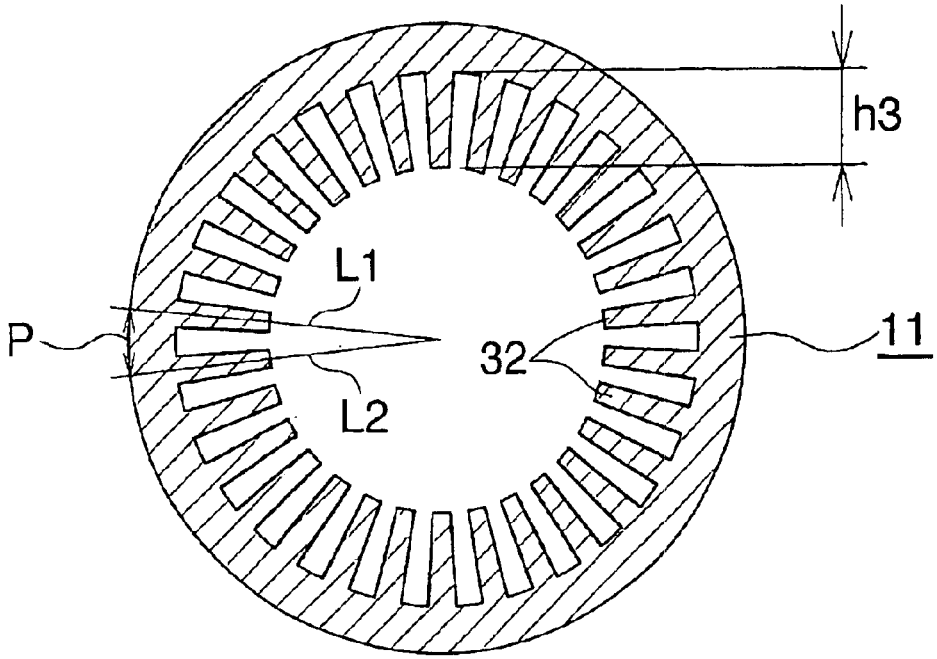
FIG. 7 is a sectional view corresponding to FIG. 2 and showing another embodiment of finned tube for use in heat exchangers.

FIG. 7 shows a modified heat exchanger finned tube.

With reference to FIG. 7, a hairpin tube 11 is integrally provided with a plurality of inner fins 32 projecting from the inner peripheral surface of the tube to equal heights, extending longitudinally thereof, and arranged circumferentially thereof at a spacing. The inner fins 32 are 0.7 to 1.2 mm in height h3 as measured from the inner peripheral surface of the hairpin tube 11. The inner fins 32 have the same pitch p as those already described. The hairpin tube 11 is 6 to 10 mm in outside diameter, and 0.4 to 0.8 mm in the thickness of the circumferential wall thereof.

Experimental examples are given below wherein heat exchangers of the invention and comparative heat exchangers were used.

EXPERIMENTAL EXAMPLE 1

Prepared were a heat exchanger 1 (invention device 1) comprising a hairpin tube 11 having the cross section shown in FIG. 2, and a heat exchanger 1 (invention device 2) comprising a hairpin tube 11 having the cross section shown in FIG. 7. The hairpin tube 11 of the heat exchanger 1 as the invention device 1 was 8 mm in outside diameter, 0.61 mm in circumferential wall thickness, 1.2 mm in the height h1 of projection of high inner fins 30, 0.65 mm in the height h2 of projection of low inner fins 31, and 30 in the combined number of two kinds of inner fins 30, 31. The hairpin tube 11 of the heat exchanger 1 as the invention device 2 was 8 mm in outside diameter, 0.61 mm in circumferential wall thickness, 1.2 mm in the height h3 of projection of inner fins 32, and 30 in the number of inner fins 32.

Figure 8:
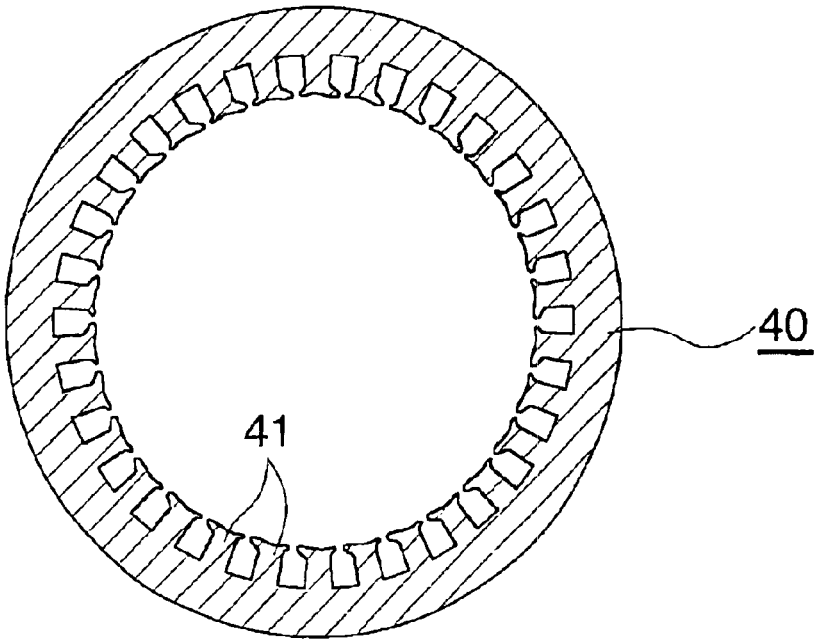
FIG. 8 is a sectional view corresponding to FIG. 2 and showing a heat exchanger finned tube for use in a comparative device 1.

Also prepared was a heat exchanger (comparative device 1) having the same construction as the invention device 1 except that the hairpin tube 40 used had the cross section shown in FIG. 8. The hairpin tube 40 was integrally provided on its inner peripheral surface with a plurality of inner fins 41 extending longitudinally of the tube and arranged at a spacing circumferentially thereof. The hairpin tube 40 was 8 mm in outside diameter, 0.61 mm in circumferential wall thickness and 30 in the number of inner fins 41. The comparative device 1 was fabricated by the conventional second process previously described, and the inner fins 41 were 0.65 mm in the height of projection before the enlargement of the tube. However, fins were somewhat collapsed at their inner ends by the enlarging mandrel.

Figure 9:
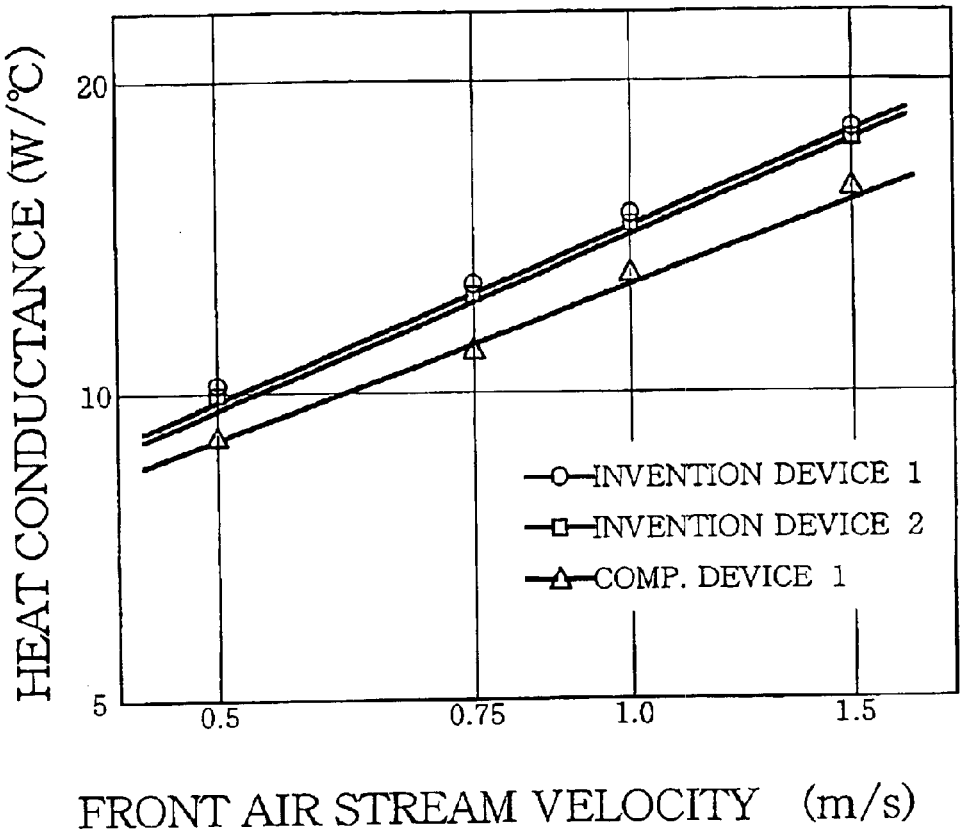
FIG. 9 is a graph showing the results of performance test in Experimental Example 1.

Evaporators comprising the invention devices 1, 2 and comparative device 1, respectively, were used and checked for performance at an inlet temperature of −19 to −22° C., refrigerant evaporation temperature of −30° C., degree of superheat of 3° C., refrigerant pressure, upstream from expansion valve, of 1.06 MPa and refrigerant circulation rate of 2 to 4 kg/h. The results obtained are given in FIG. 9, which reveals that the invention devices 1 and 2 are approximately 10% higher in performance.

EXPERIMENTAL EXAMPLE 2

Evaporators comprising the invention devices 1, 2 and comparative device 1 were incorporated into refrigerators, which were installed in an atmosphere having a temperature of 25° C. and relative humidity of 70%. The refrigerators were then tested for power consumption by operating the compressor intermittently by on/off control with the door closed. As a result, the refrigerator incorporating the invention device 1 as its evaporator was found to be 2% lower in power consumption than the refrigerator incorporating the comparative device 1 as the evaporator. Similarly, the refrigerator incorporating the invention device 2 as its evaporator was 1.3% lower in power consumption than the refrigerator incorporating the comparative device I as the evaporator.

INDUSTRIAL APPLICABILITY

The heat exchanger finned tube of the invention is used for fabricating heat exchangers for use as evaporators in refrigeration devices such as refrigerators and refrigerated showcases, and is suited especially for fabricating heat exchangers useful as the evaporators of refrigeration devices wherein hydrocarbon refrigerant is used.

What is claimed is:

1. A finned tube for use in heat exchangers which comprises a hairpin tube having two straight tube portions, and a plurality of fin groups arranged on the straight tube portions longitudinally thereof at a spacing, each of the fin groups comprising a plurality of parallel plate fins extending across and fixed to the two straight tube portions. each of the plate fins having two tube insertion holes spaced apart from each other, the plate fins being fixedly fitted around an enlarged tube portion of the hairpin tube by inserting the two straight tube portions through the respective holes of each plate fin and enlarging the hairpin tube with use of a fluid, the straight tube portions each having a finless part between each pair of adjacent fin groups thereon, at least one of all the finless parts of each straight tube portion having a restrained small-diameter portion smaller than the enlarged tube portion in diameter and having a predetermined length.

2. A finned tube for use in heat exchangers according to claim 1 wherein the restrained small-diameter portion is provided in each of the finless parts of each straight tube portion of the hairpin tube.

3. A finned tube for use in heat exchangers according to claim 1 wherein each of opposite ends of the restrained small-diameter portion is made integral with the enlarged tube portion by a flaring portion formed therebetween and increasing in diameter toward the enlarged tube portion.

4. A finned tube for use in heat exchangers according to claim 1 wherein the restrained small-diameter portion is an unenlarged tube portion.

5. A finned tube for use in heat exchangers according to claim 1 wherein the hairpin tube is integrally provided on an inner peripheral surface thereof with inner fins extending longitudinally thereof and arranged at a spacing circumferentially thereof.

6. A finned tube for use in heat exchangers according to claim 5 wherein the hairpin tube has high and low two kinds of inner fins alternately arranged circumferentially thereof and projecting from the inner peripheral surface of the tube to different heights, the high inner fins being 0.7 to 1.7 mm in height from the surface of the hairpin tube, the low inner fins being 0.4 to 1.2 mm in height from the surface.

7. A finned tube for use in heat exchangers according to claim 5 wherein all the inner fins are equal in height and are 0.7 to 1.2 mm in height from the inner peripheral surface of the hairpin tube.

8. A finned tube for use in heat exchangers according to claim 6 wherein the pitch of the inner fins is 0.4 to 1.6 mm.

9. A finned tube for use in heat exchangers according to claim 6 wherein the hairpin tube is 6 to 10 mm in outside diameter and 0.4 to 0.8 mm in the wall thickness of a circumferential wall thereof.

10. A heat exchanger comprising a heat exchanger finned tube according to claim 1 and formed in a zigzag shape in its entirety by bending the straight tube portions of the hairpin tube in the same direction at each pair of finless parts located in the same position with respect to the longitudinal direction of the straight tube portions, each pair of finless parts adjacent to each other longitudinally of the straight tube portions being bent in different directions.

11. A heat exchanger according to claim 10 wherein each finless part of each of the straight tube portions of the hairpin tube has a restrained small-diameter portion, and the heat exchanger finned tube is bent at the restrained small-diameter portion of each finless part.

12. A heat exchanger according to claim 10 wherein the hairpin tube is integrally provided on an inner peripheral surface thereof with inner fins extending longitudinally thereof and arranged at a spacing circumferentially thereof.

13. A heat exchanger according to claim 12 wherein the hairpin tube has high and low two kinds of inner fins alternately arranged circumferentially thereof and projecting from the inner peripheral surface of the tube to different heights, the high inner fins being 0.7 to 1.7 mm in height from the surface of the hairpin tube, the low inner fins being 0.4 to 1.2 mm in height from the surface.

14. A heat exchanger according to claim 13 wherein the pitch of the inner fins is 0.4 to 1.6 mm.

15. A heat exchanger according to claim 13 wherein the hairpin tube is 6 to 10 mm in outside diameter and 0.4 to 0.8 mm in the wall thickness of a circumferential wall thereof.

16. A heat exchanger according to claim 12 wherein all the inner fins are equal in height and are 0.7 to 1.2 mm in height from the inner peripheral surface of the hairpin tube.

17. A heat exchanger according to claim 16 wherein the pitch of the inner fins is 0.4 to 1.6 mm.

18. A heat exchanger according to claim 16 wherein the hairpin tube is 6 to 10 mm in outside diameter and 0.4 to 0.8 mm in the wall thickness of a circumferential wall thereof.

19. A refrigerator which is provided with a refrigeration cycle having a compressor, a condenser and an evaporator, the evaporator being a heat exchanger according to claim 10, and wherein a hydrocarbon refrigerant is used as the refrigerant and circulated at a rate of 1 to 9 kg/h.

20. A refrigerated showcase which is provided with a refrigeration cycle having a compressor, a condenser and an evaporator, the evaporator being a heat exchanger according to claim 10, and wherein a hydrocarbon refrigerant is used as the refrigerant and circulated at a rate of 1 to 9 kg/h.

21. A process for producing a finned tube for use in heat exchangers which process comprises preparing a hairpin tube having two straight tube portions, and a multiplicity of plate fins each having two tube insertion holes spaced apart from each other, inserting the two straight tube portions through the respective holes of each plate fin to arrange the plate fins in parallel into a plurality of fin groups spaced apart on the straight tube portions longitudinally thereof and provide a finless part between each pair of adjacent fin groups on each of the straight tube portions, restraining at least one of all the finless parts of each straight tube portion by a restraining die having a cylindrical restraining portion with a diameter smaller than the inside diameter of the tube insertion holes of the plate fins, and introducing a fluid into the hairpin tube in this state to enlarge the tube and fixedly fit the plate fins of each fin group around an enlarged tube portion of the hairpin tube.

22. A process for producing a finned tube for use in heat exchangers according to claim 21 wherein each of the finless parts of each straight tube portion of the hairpin tube is restrained by the restraining die.

23. A process for producing a finned tube for use in heat exchangers according to claim 21 wherein the restraining die has a cavity comprising a cylindrical restraining portion having a predetermined length, two flaring portions extending from respective opposite ends of the restraining portion and increasing in diameter outward longitudinally of the restraining portion, and tube enlargement permitting portions extending from respective larger ends of the flaring portions and having an inside diameter not smaller than the inside diameter of the holes of the plate fins.

24. A process for producing a finned tube for use in heat exchangers according to claim 21 wherein the restraining portion has an inside diameter equal to the outside diameter of the hairpin tube before enlargement.

25. A process for producing a finned tube for use in heat exchangers according to claim 21 wherein the hairpin tube is integrally provided on an inner peripheral surface thereof with inner fins extending longitudinally thereof and arranged at a spacing circumferentially thereof.

26. A process for producing a finned tube for use in heat exchangers according to claim 25 wherein the hairpin tube has high and low two kinds of inner fins alternately arranged circumferentially thereof and projecting from the inner peripheral surface of the tube to different heights, the high inner fins being 0.7 to 1.7 mm in height from the surface of the hairpin tube, the low inner fins being 0.4 to 1.2 mm in height from the surface.

27. A process for producing a finned tube for use in heat exchangers according to claim 25 wherein all the inner fins are equal in height and are 0.7 to 1.2 mm in height from the inner peripheral surface of the hairpin tube.

28. A process for producing a finned tube for use in heat exchangers according to claim 26 wherein the pitch of the inner fins is 0.4 to 1.6 mm.

29. A process for producing a finned tube for use in heat exchangers according to claim 26 wherein the hairpin tube is 6 to 10 mm in outside diameter and 0.4 to 0.8 mm in the wall thickness of a circumferential wall thereof.

30. A process for fabricating a heat exchanger comprising a heat exchanger finned tube produced by a process according to claim 21, the heat exchanger being formed in a zigzag shape in its entirety by bending the straight tube portions of the hairpin tube in the same direction at each pair of finless parts located in the same position with respect to the longitudinal direction of the straight tube portions, each pair of finless parts adjacent to each other longitudinally of the straight tube portions being bent in different directions.

31. A process for fabricating a heat exchanger according to claim 30 by using a heat exchanger finned tube wherein the finned tube is bent at the portion of the finless part restrained by the restraining portion of the restraining die.

32. A process for fabricating a heat exchanger according to claim 30 wherein the hairpin tube of the heat exchanger finned tube is integrally provided on an inner peripheral surface thereof with inner fins extending longitudinally thereof and arranged at a spacing circumferentially thereof.

33. A process for fabricating a heat exchanger according to claim 32 wherein the hairpin tube has high and low two kinds of inner fins alternately arranged circumferentially thereof and projecting from the inner peripheral surface of the tube to different heights, the high inner fins being 0.7 to 1.7 mm in height from the surface of the hairpin tube, the low inner fins being 0.4 to 1.2 mm in height from the surface.

34. A process for fabricating a heat exchanger according to claim 32 wherein all the inner fins are equal in height and are 0.7 to 1.2 mm in height from the inner peripheral surface of the hairpin tube.

35. A process for fabricating a heat exchanger according to claim 33 wherein the pitch of the inner fins is 0.4 to 1.6 mm.

36. A process for fabricating a heat exchanger according to claim 33 wherein the hairpin tube is 6 to 10 mm in outside diameter and 0.4 to 0.8 mm in the wall thickness of a circumferential wall thereof.

* * * * *